United States Patent [19]

Slack

[11] Patent Number: 5,077,537

[45] Date of Patent: Dec. 31, 1991

[54] THERMOSTATIC PROBE SWITCH APPARATUS

[75] Inventor: Douglas J. Slack, Modbury Heights, Australia

[73] Assignee: Texas Instruments Incorporated, Dallas, Tex.

[21] Appl. No.: 628,265

[22] Filed: Dec. 14, 1990

[51] Int. Cl.[5] ..... H01H 37/12; H01H 37/46

[52] U.S. Cl. ..... 337/392; 337/382; 337/391

[58] Field of Search ..... 337/392, 391, 390, 389, 337/397, 131, 382, 388

[56] References Cited

U.S. PATENT DOCUMENTS 4,166,995 9/1979 Pecker et al. ..... 337/390

4,754,253 6/1988 Slack et al. ..... 337/392

*Primary Examiner*—Harold Broome

*Attorney, Agent, or Firm*—John A. Haug; James P. McAndrews; Melvin Sharp

[57] ABSTRACT

A probe thermostat is shown having a single, stamped metal channel having a first coefficient of expansion coupled to a rod having a second, different, coefficient of expansion. An electrically insulating block is mounted on the channel which in turn cantilever mounts a pair of electrically conductive arms spaced one over the other with electrical contacts disposed on the arms in facing relation to one another. A molded plastic adjustment cam snaps into slots formed in the channel to adjust the position of the lower arm. A hinge formed in the channel and connected to the rod causes movement of the top arm as the temperature of the thermostat changes to cause the contacts to move into and out of engagement with each other.

13 Claims, 4 Drawing Sheets

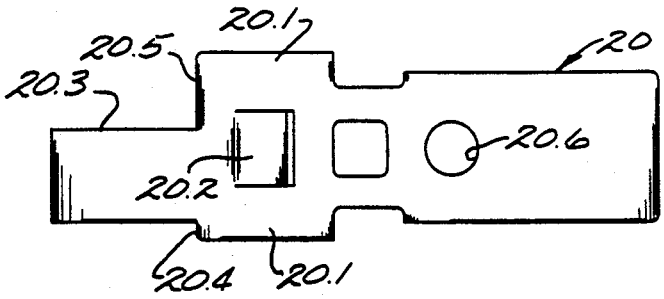
Fig. 15.
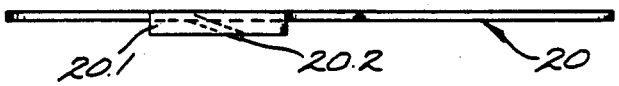
Fig. 16.
Fig. 17.
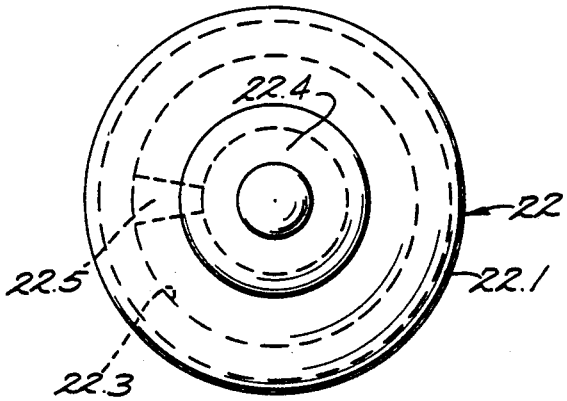
Fig. 18.
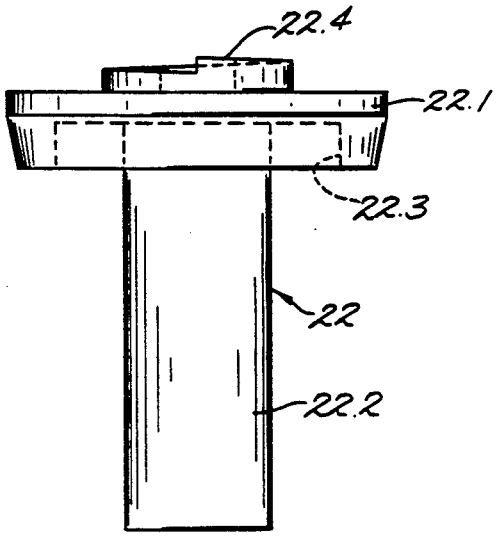

THERMOSTATIC PROBE SWITCH APPARATUS

This invention relates to thermostatic electrical switches and more particularly to a thermostat of the general type shown and described in U.S. Pat. No. 4,754,253, assigned to the assignee of the present invention. In that patent a hollow body of insulating material is shown in which temperature adjustment means project from a side of the body and an electric switch is mounted within the body with the blades of the switch supported directly from the body of insulating material. A probe assembly comprising a channel shaped member extends outwardly from an end of the body of insulating material with a rod of low expansion material supported within the open channel with one end attached to an end of the channel and the other end especially configured for attachment to a hinge formed integrally with the channel shaped member within the hollow body which actuates the switch through an insulator which isolates the switch from the probe.

Although the thermostat disclosed in the patent is effective it is an object of the present invention to provide a cost reduced probe thermostat with fewer assembly operations required for assembly. Another object is the provision of a probe thermostat which has improved sensitivity for sensing temperature.

Briefly, in accordance with the invention, a unitary, stamped, metal channel having a first coefficient of thermal expansion is formed with a bottom wall and side walls and a rod having a second, different, coefficient of thermal expansion fixedly attached at a first end thereof with a first end of the channel and a second end thereof fixedly attached to a tongue which is struck from a hinge element which hinge element in turn is struck from the bottom wall of the channel. According to a feature of the invention the tongue has a distal end portion which lies in a plane spaced above the tongue and generally parallel therewith to which the rod is attached.

According to another feature of the invention a single block of electrically insulative material is received in slots formed in the side walls at the second end of the channel and has a pair of slots extending through the block, one over the other, which receive first and second conductive arms. Electrical contacts are mounted on the arms in facing relation to one another and are adapted to move into and out of engagement with each other. A motion transfer member attached to the distal free portion of the hinge element is adapted to transfer motion to the upper arm to move its respective electrical contact into and out of engagement with the other electrical contact.

According to another feature of the invention a generally circular cam plate is captured in slots formed in the side walls intermediate the slots formed at the second end of the channel and the hinge. A vertically adjustable spacing member is mounted on the lower conductive arm and is adapted to engage a cam surface on the cam plate. The cam plate has a shaft depending therefrom through a bore in the bottom wall of the channel to permit rotational movement of the plate with concomitant adjustment of the vertical position of the lower conductive arm. A tab extends upwardly from the bottom wall into a discontinuous groove in the bottom surface of the cam plate to limit rotational movement of the cam plate.

BRIEF DESCRIPTION OF THE DRAWINGS

Other objects, advantages and details of the novel and improved probe thermostat apparatus appear in the following detailed description of the preferred embodiment of the invention, the detailed description referring to the drawings in which:

FIGS. 15 and 16 are top and front views respectively of a second conductive arm which is mountable in the block of FIGS. 11 and 12; and FIGS. 17 and 18 are top and front views respectively of a cam adjustment plate used in the FIGS. 1–3 thermostat.

Figure 1:
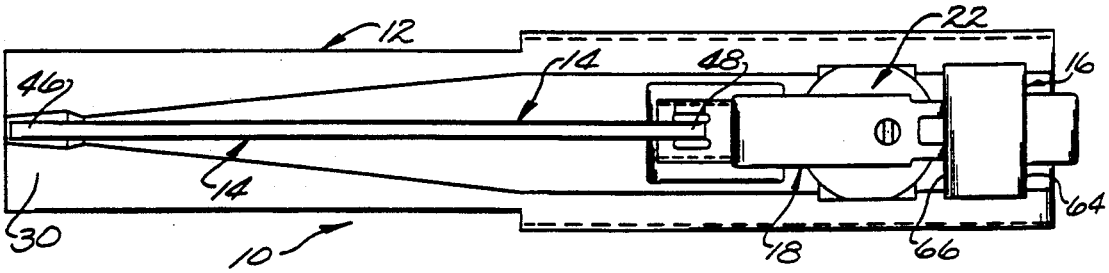
FIG. 1 is a top plan view of a probe thermostat made in accordance with the invention.
Figure 2:
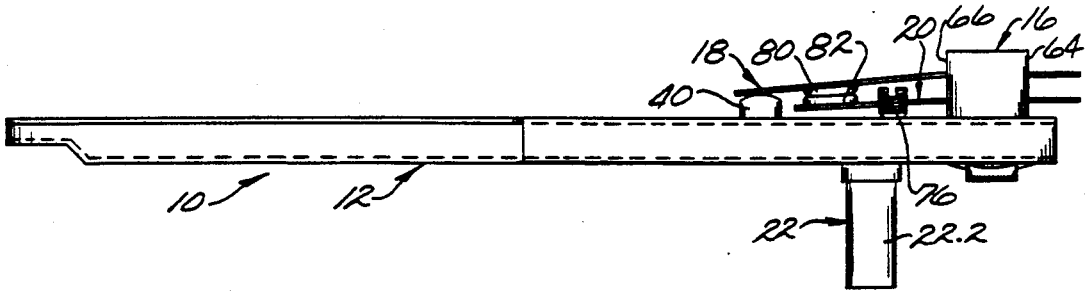
FIGS. 2 and 3 are front and side views respectively of the FIG. 1 thermostat.
Figure 3:
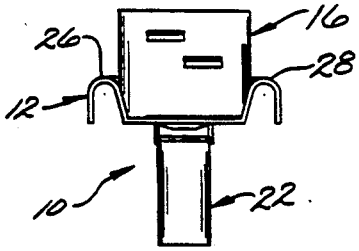

A probe thermostat 10 made according to the present invention is shown in FIGS. 1–3 and comprises an elongated channel shaped body 12 mounting a rod 14, an electrically insulative block 16, conductive arms 18 and 20 mounted in block 16 and cam adjustment member 22.

Figure 4:
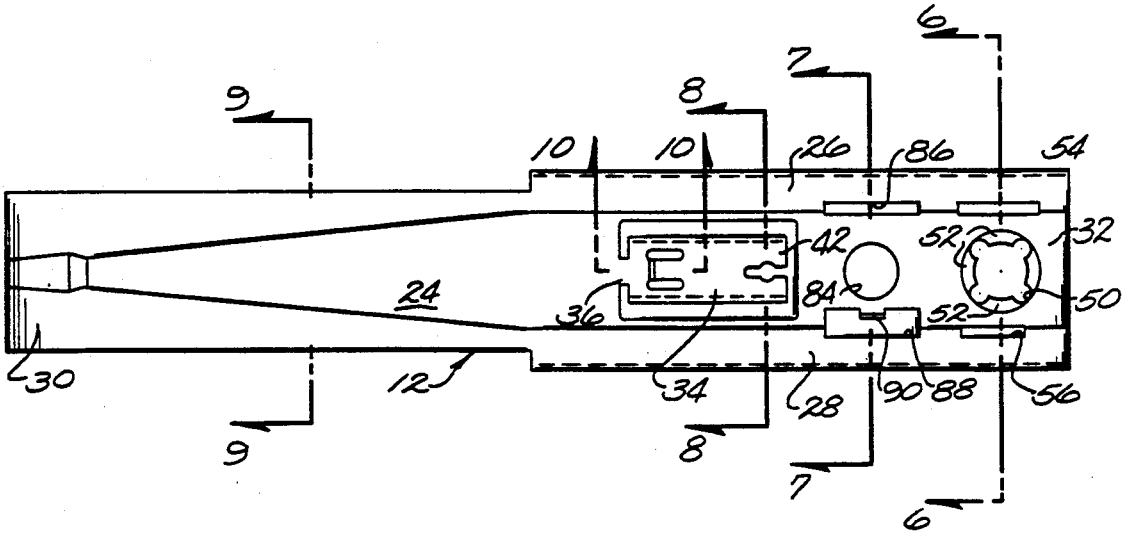
FIG. 4 is a top plan view of the channel portion of the FIG. 1 thermostat.
Figure 5:
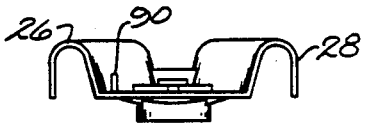
FIG. 5 is a side view of the FIG. 4 channel portion.
Figure 6:
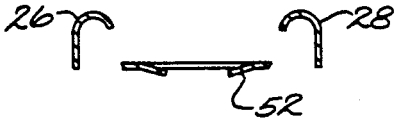
FIGS. 6 through 10 are cross sectional views taken on lines 6 through 10 respectively of FIG. 4.

With particular reference to FIG. 4, channel body 12 has a bottom wall 24 and opposed, generally U-shaped side walls 26, 28 and extends from a first end 30 to an opposite, second end 32. Channel body 12 is formed of suitable metal material which may readily be stamped and has a first coefficient of thermal expansion.

Figure 10:
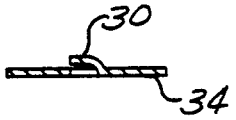

A hinge element 34 is formed in the bottom wall 24 of channel body 12 by separating it, as by stamping, on three sides thereof leaving a neck portion 36 about which element 34 can bend. A tongue 38 (see FIG. 10) is struck out of element 34 and bent upwardly with a distal portion lying in a plane generally parallel with the plane of element 34 for a purpose to be discussed below. Hinge element 34 mounts a motion transfer member 40 (FIG. 2}at a distal end portion 42 of element 34.

An elongated rod 14 (FIG. 1) formed of a material having a second coefficient of expansion different from that of channel body 12, has a first end 46 fixedly attached as by welding to first end 30 of channel body 12 and its opposite, second end 48 fixedly attached, as by welding, to tongue 38. When exposed to changes in temperature the differential in expansion between the channel body 12 and rod 44 will cause pivoting of hinge element 38 and generally vertical movement of member 40.

An aperture 50 is formed in bottom wall 24 adjacent the second end 32 of channel body 12 with tabs 52 projecting into the aperture and bent to extend downwardly. A pair of slots 54, 56 are formed in side walls 26, 28 respectively in alignment with each other and with aperture 50. Slot 56 is formed somewhat shorter then slot 54 for a purpose to be discussed below.

Figure 11:
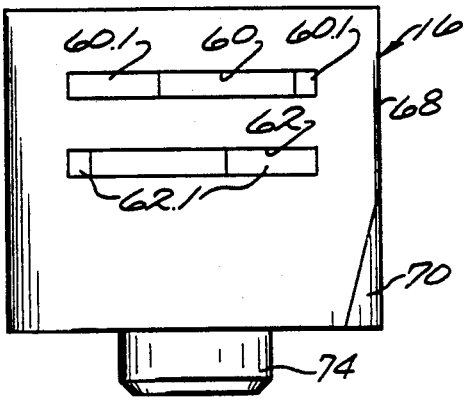
FIGS. 11 and 12 are side and front elevational views of an electrically insulative block used in the FIGS. 1–3 thermostat.
Figure 12:
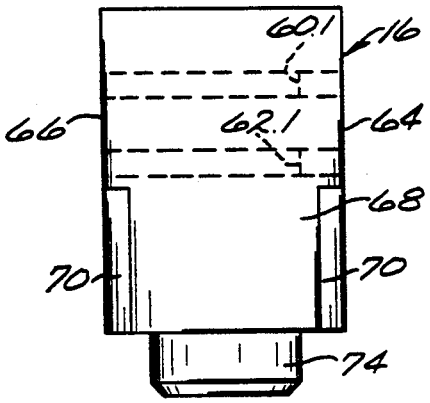
Figure 13:
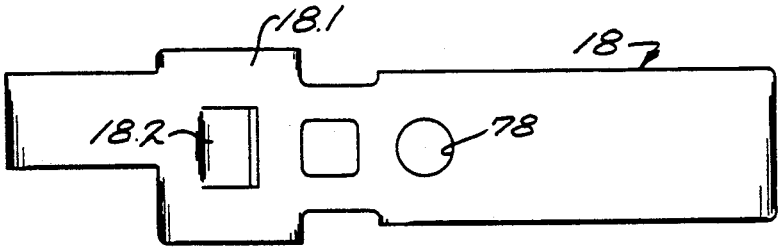
FIGS. 13 and 14 are top and front views respectively of a first conductive arm which is mountable in the block of FIGS. 11 and 12.
Figure 14:
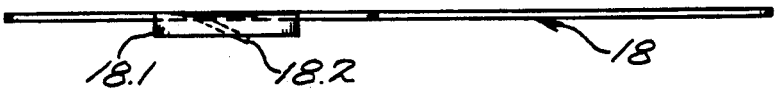

As seen in FIGS. 11, 12 a block 16 of moldable electrically insulating material such as a plastic material, has a pair of slots 60, 62 formed one over the other and extending through the block from one end surface 64 to an opposite end surface 66. Side 68 of block 16 is provided with cut out portions 70 of a size chosen so that the central portion of side 68 between cut out portions 70 will fit into slot 56 while opposite side 72 is received in slot 54. This will assure a proper orientation of block 16. A post 74 depends downwardly from block 16 and is received in aperture 50 with tabs 52 biased against the post to effectively lock the block in its seat.

First and second elongated arms 18, 20 are respectively received in slots 60, 62 in spaced apart relation. The arms are formed with similar mounting or body portions comprising downwardly extending flanges 18.1, 20.1 respectively on opposites sides thereof to ensure a tight fit in the slots of body 16. Tab 18.2, 20.2 respectively extends downwardly in a direction away from terminal portion 18.3, 20.3 and shoulders 18.4, 18.5 and 20.4, 20.5 respectively extend from opposite sides of the terminal portion. The length of the shoulders are reversed so that the terminals are offset relative to one another when the arms are in vertical alignment one on top of the other. Terminal 18 is inserted in slot 60 and terminal 20 is inserted in slot 62 from side 66 of the block and forced into the block until the shoulders abut stop surfaces 60.1, 62.1 respectively with the arms locked in place.

A threaded spacing member 76 is threaded in bore 20.6 of conductive arm 20 for a purpose to be described below. A bore 78 is formed in arm 18 in alignment with bore 20.6 to provide access to member 76 for rotational adjustment of member 76. Electrical contacts 80, 82 are mounted on respective arms 18, 20 in facing relation with one another with contact 82 disposed at the free distal end of arm 20. Arm 18 projects beyond contact 80 to permit its distal free end to engage motion transfer member 40 (see FIG. 2).

Figure 7:
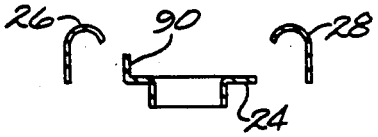
Figure 8:
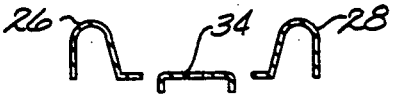
Figure 9:
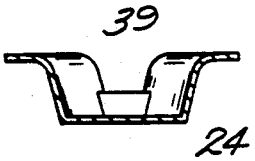

A bore 84 is formed in bottom wall 24 intermediate bore 50 and hinge 34. A pair of slots 86, 88 are formed in side walls 26, 28 respectively in alignment with each other and with bore 84. A tab 90 (FIG. 7) projects upwardly from bottom wall 24 adjacent slot 88.

With reference to FIGS. 17, 18 cam adjustment member 22 comprises a generally circular molded plastic cam plate 22.1 with a shaft 22.2 depending downwardly therefrom. A discontinuous annular groove 22.3 is formed on the bottom surface of plate 22.1 and a cam surface 22.4 of varying height around an annular ring is formed on the top of plate 22.1. Shaft 22.2 is received through bore 84 with the outer periphery of plate 22.1 snapped into slots 86, 88 with tab 90 extending into groove 22.3. Portion 22.5 of plate 22 defining the respective ends of groove 22.3 serves to limit rotational movement of member 22 by engagement of tab 90 therewith.

The cam surface 22.4 is adapted to engage spacing member 76 and, by selected rotational adjustment, control the position of contact 82. Contact 80 is adapted to move into and out of electrical engagement with contact 82 dependent upon the temperature of the channel and rod member with the related position of the distal portion of hinge element 34 and motion transfer member 40.

The single, stamped metal channel provides increased thermal contact with a heat source at the same time as reducing the number of parts and secondary assembly operations previously required for similar probe thermostats. Other advantages that the invention provides are that the number of welds is reduced, no bracket tapping operation is required for the adjusting screw, the hinge assembly does not require a rod with a specially formed end and it is easier to maintain relative positioning of crucial parts. The use of snap-in molded plastic cam member obviates tapping or screw threading. The use of block 16 obviates the need of a multi-layered stack arrangement of the prior art and does not require screws or rivets for assembly and is conducive to automated assembly operations.

It should be understood that although a particular embodiment of the thermostat has been described by way of illustrating the invention, the invention includes all the modifications and equivalents of the described embodiment falling within the scope of the appended claims.

I claim:

1. A thermostatic switch comprising an electric switch having contacts which are movable relative to one another into and out of engagement, temperature sensing means, the temperature sensing means comprising an elongated channel having a first coefficient of expansion and first and second ends and an elongated rod having a second coefficient of expansion different from the first and having first and second ends, the rod extending parallel to the channel and having the first end thereof fixedly attached to the first end of the channel, a hinge portion cut out on three sides from the channel intermediate its ends, the second end of the rod fixedly attached to the hinge portion, the hinge portion having a free distal end portion adapted to move in response to changes in sensed temperature, the electric switch comprising first and second elongated electrically conductive arms mounted one over the other on the channel intermediate the hinge and the other end of the channel, the arms electrically separated from each other and from the channel, the contacts mounted on the respective arms in facing relation with one another and the free distal end portion of the hinge operatively connected to the uppermost arm whereby upward movement of the free distal end portion of the hinge will cause upward movement of the uppermost arm.

2. A thermostatic switch according to claim 1 in which the first and second elongated electrically conductive arms are mounted in a block of electrically insulative material received on the channel, the block having first and second spaced slots in which the respective first and second arms are disposed, the arms extending from a side of the block toward the first end of the channel and having terminal portions extending from another side extending toward the second end of the channel.

3. A thermostatic switch according to claim 2 in which the channel is formed with generally U-shaped side walls extending substantially from the hinge portion to the second end of the channel on opposite sides of a bottom wall, a slot is formed in each of the side walls in alignment with each other and the block is received in the slots, an aperture is formed in the bottom wall in alignment with the slots, a plurality of tabs extending into the aperture, the block having a downwardly extending post which is received in the aperture with the tabs pressed against the post to lock it in position.

4. A thermostatic switch according to claim 3 in which one of the slots is essentially the same length as the width of the block and the other slot smaller than the one slot and the block is provided with a cut out portion adapted to closely fit in the smaller slot.

5. A thermostatic switch according to claim 1 in which the channel is formed with generally U-shaped side walls extending substantially from the hinge portion to the second end of the channel on opposite sides of a bottom wall, a slot is formed in each of the side walls in alignment with each other and a bore is formed in the bottom wall in alignment with the slots, a generally circular cam plate having a pivotable shaft depending from a bottom thereof is received on the bottom wall with the pivotable shaft extending through the bore and the outer periphery of the plate is received in the slots, and a cam surface is formed on the top surface of the plate and spacing means is mounted on the lowermost elongated arm and extends downwardly into engagement with the cam surface whereby pivotable movement of the shaft will cause concomitant vertical movement of the spacing means and the lowermost elongated arm.

6. A thermostatic switch according to claim 5 in which the spacing means is an adjustable threaded member received in a bore formed in the lowermost elongated arm.

7. A thermostatic switch according to claim 5 in which a discontinuous annular groove is formed in the bottom surface of the cam plate and a tab extends upwardly from the bottom wall into the groove to limit the degree of rotation of the shaft.

8. A thermostatic switch according to claim 1 in which the hinge portion has a bottom wall and a tongue is formed out of the bottom wall and has a distal end extending in a plane parallel to the plane of the bottom wall and spaced above the bottom wall and the second end of the rod is fixedly attached to the tongue.

9. A thermostatic switch comprising an elongated channel having a first coefficient of expansion and first and second ends and having a bottom wall and opposed side walls and an elongated rod having a second coefficient of expansion different from the first and having first and second ends, the rod extending parallel to the channel and having the first end thereof fixedly attached to the first end of the channel, a hinge element formed in the bottom wall of the channel by separating three sides of the hinge element from the bottom wall at a location intermediate the ends of the channel, the second end of the rod fixedly attached to the hinge element, the hinge element having a free distal end portion adapted to move in response to changes in sensed temperature, a first pair of slots formed in the side walls in alignment with each other located between the hinge portion and the second end of the channel and an aperture formed in the bottom wall in alignment with the first pair of slots, a plurality of tabs extending into the aperture, a block of electrically insulating material having a downwardly depending post received in the slots with the post extending through the aperture with the tabs biased against the post, a pair of slots extending through the block one over the other generally parallel to the bottom wall of the channel, first and second elongated electrically conductive arms received in the respective slots, electrical contacts mounted in facing relation on the arms and adapted to move into and out of engagement with each other, the uppermost arm operatively connected to the distal end portion of the hinge element, a second pair of slots formed in the side walls in alignment with each other and intermediate the first pair of slots and the hinge element, a bore formed in the bottom wall in alignment with the second pair of slots, a generally circular cam plate having a pivotable shaft depending from a bottom thereof received on the bottom wall with the pivotable shaft extending through the bore and the outer periphery of the plate received in the second pair of slots, and a cam surface formed on the top surface of the plate and spacing means mounted on the lowermost elongated arm and extending downwardly into engagement with the cam surface whereby pivotable movement of the shaft will cause concomitant vertical movement of the spacing means and the lowermost elongated arm.

10. A thermostat switch according to claim 9 in which the spacing means is an adjustable threaded member received in a bore formed in the lowermost elongated arm.

11. A thermostatic switch according to claim 9 in which a discontinuous annular groove is formed in the bottom surface of the cam plate and a tab extends upwardly from the bottom wall into the groove to limit the degree of rotation of the shaft.

12. A thermostatic switch according to claim 9 in which the hinge portion has a bottom wall and a tongue is formed out of the bottom wall and has a distal end extending in a plane parallel to the plane of the bottom wall and spaced above the bottom wall and the second end of the rod is fixedly attached to the tongue.

13. A thermostatic switch comprising an electric switch having contacts which are movable relative to one another into and out of engagement, temperature sensing means, the temperature sensing means comprising an elongated channel having a first coefficient of expansion and first and second ends and an elongated rod having a second coefficient of expansion different from the first and having first and second ends, the rod extending parallel to the channel and having the first end thereof fixedly attached to the first end of the channel, a hinge portion formed in the channel intermediate its ends, the second end of the rod fixedly attached to the hinge portion, the hinge portion having a free distal end portion adapted to move in response to changes in sensed temperature, the electric switch comprising first and second elongated electrically conductive arms mounted one over the other on the channel intermediate the hinge and the other end of the channel, the arms electrically separated from each other and from the channel, the contacts mounted on the respective arms in facing relation with one another and the free distal end portion of the hinge operatively connected to one of the arms whereby movement of the free distal end portion of the hinge will cause movement of the said one arm.

* * * * *